US009021970B2

(12) United States Patent
Kawakita

(10) Patent No.: US 9,021,970 B2
(45) Date of Patent: May 5, 2015

(54) PROPULSION DEVICE AND SHIP USING THE SAME

(75) Inventor: Chiharu Kawakita, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 30 days.

(21) Appl. No.: 13/805,736

(22) PCT Filed: Oct. 7, 2011

(86) PCT No.: PCT/JP2011/073207

§ 371 (c)(1),
(2), (4) Date: Dec. 20, 2012

(87) PCT Pub. No.: WO2012/053378

PCT Pub. Date: Apr. 26, 2012

(65) Prior Publication Data

US 2013/0102209 A1 Apr. 25, 2013

(30) Foreign Application Priority Data

Oct. 19, 2010 (JP) ..... 2010-234853

(51) Int. Cl.
*B63B 1/08* (2006.01)
*B63H 5/08* (2006.01)
(Continued)

(52) U.S. Cl.
CPC .. *B63H 5/08* (2013.01); *B63B 1/08* (2013.01); *B63H 1/18* (2013.01); *B63H 1/26* (2013.01)

(58) Field of Classification Search
CPC ..... B63B 1/00; B63B 1/08; B63H 1/28; B63H 5/00; B63H 5/08; B63H 5/16
USPC ..... 114/57; 440/49
See application file for complete search history.

(56) References Cited

U.S. PATENT DOCUMENTS 3,416,480 A * 12/1968 Pien ..... 114/57
3,991,697 A * 11/1976 Taniguchi et al. ..... 114/57
4,288,223 A * 9/1981 Gonzalez et al. ..... 440/71

FOREIGN PATENT DOCUMENTS

CN 101137538 3/2008
EP 1 892 183 2/2008
JP 59-28958 8/1984
(Continued)

OTHER PUBLICATIONS

Korean Office Action issued Feb. 6, 2014 in corresponding Korean Patent Application No. 10-2012-7033031 with English translation.
(Continued)

*Primary Examiner* — Lars A Olson
(74) *Attorney, Agent, or Firm* — Wenderoth, Lind & Ponack, L.L.P.

(57) ABSTRACT

A propulsion device of the ship includes a port side screw propeller; and a starboard side screw propeller provided in a forward or backward direction in a longitudinal direction of the ship from the port side screw propeller, such that a part of propeller wings of the starboard side screw propeller overlaps with propeller wings of the port side screw propeller. One of the port side screw propeller and the starboard side screw propeller, which is on a forward side in a longitudinal direction of the ship, is the forward screw propeller, and the other is the backward screw propeller. The forward screw propeller has a wing shape by which tip vortex cavitation is more difficult to be generated by the forward screw propeller than the backward screw propeller.

24 Claims, 7 Drawing Sheets

(51) Int. Cl.
*B63H 1/18* (2006.01)
*B63H 1/26* (2006.01)

(56) References Cited

FOREIGN PATENT DOCUMENTS

| | | |
|---|---|---|
| JP | 61-268593 | 11/1986 |
| JP | 2-86897 | 7/1990 |
| JP | 5-26796 | 4/1993 |
| JP | 6-59871 | 8/1994 |
| JP | 7-156874 | 6/1995 |
| JP | 7-267188 | 10/1995 |
| JP | 2006-015972 | 1/2006 |
| JP | 2011-98696 | 5/2011 |
| KR | 10-1983-0004110 | 7/1983 |
| KR | 10-2005-0102971 | 10/2005 |
| WO | 2006/095774 | 9/2006 |
| WO | 2010/016155 | 2/2010 |

OTHER PUBLICATIONS

International Search Report issued Jan. 17, 2012 in International (PCT) Application No. PCT/JP2011/073207.
International Preliminary Report on Patentability and Written Opinion of the International Searching Authority issued May 8, 2013 in International (PCT) Application No. PCT/JP2011/073207.
Office Action and Search Report issued Oct. 20, 2014 in corresponding Chinese Application No. 201180030474.5 with partial English translation.
Decision to Grant a Patent issued Dec. 5, 2014 in corresponding Japanese Patent Application No. 2010-234853 with partial English translation.

* cited by examiner

PROPULSION DEVICE AND SHIP USING THE SAME

TECHNICAL FIELD

The present invention is related to a ship, and more particularly to a propulsion device of a ship.

BACKGROUND ART

As an example of a propulsion device of a ship, a system of single-engine single-axis (one main engine and one propeller) and a system of twin-engine twin-axis (two main engines and two propellers) are known. As the propulsion device of a general commercial ship, the single-engine single-axis system and the twin-engine twin-axis system are often adopted. The ship which adopts the former is called a single-screw ship, and the ship which adopts the latter is called a twin-screw ship.

Also, in recent years, as the ship becomes larger in size, problems are caused such as the lowering of propulsive efficiency in accompaniment with increase of a load to a screw propeller, and the increase of hull vibration and the occurrence of erosion in accompaniment with extension of a cavitation range in the single-screw ship. It is known that these problems can be solved by the twin-screw ship. In the twin-screw ship, loading one propeller is reduced to improve the propeller efficiency and the occurrence range of the cavitation can be narrowed.

As an example that two screw propellers are provided at the stern of a ship, an overlapping propeller (OLP) type, an interlock propeller type, a two-propeller parallel arrangement type, and so on are known. In the OLP type, two propellers are arranged to be displaced in a forward or backward direction, such that the two propellers are overlap each other when viewed from the stern. The propulsion efficiency can be improved by 5-10% in the OLP type of ship, compared with that of the single-screw ship. Also, in the interlock propeller type of ship, the propellers are arranged such that each wing of one screw propeller appears between the wings of the other propeller. In the two-propeller parallel arrangement type of ship, the two propellers are arranged symmetrically in parallel to each other in a longitudinal direction of the ship.

Here, when two screw propellers are arranged in the stern structure of a single-screw ship (having a skeg type of stern in which a stern central portion is made thin to bring the propellers close to each other), it is desirable from the viewpoint of a slow water flow near the hull centerline and longitudinal vortices such as bilge vortices that the propellers are arranged in the neighborhood of the hull centerline. In the propeller position of a usual single-screw ship, the longitudinal vortices of a slow water flow, which are such as a pair of the bilge vortices symmetrical with respect to the hull centerline and rotating into an inboard direction, are generated in the stern. Because the propeller is designed to have a high efficiency in the slow flow, the propulsion efficiency can be improved by rotating the propeller near the longitudinal vortices and collecting the slow flow and the longitudinal vortices in the neighborhood of the hull centerline. In case of the OLP type of ship, the outboard direction is often adopted as the rotation direction of the propeller, in order to collect the longitudinal vortices near the hull center efficiently for improvement of propulsion performance.

For example, in Patent Literature 1 (WO2006/095774), a technique is disclosed in which the propeller loading and the generation cavitation can be reduced when using the OLP structure for the stern portion of a single-screw ship.

CITATION LIST

[Patent Literature 1]: WO2006/095774

SUMMARY OF THE INVENTION

However, in case of the twin-screw ship using the OLP structure, there is a possibility that tip vortex cavitations (TVC) generated at wing tips of the forward screw propeller hit the backward screw propeller to cause erosion on the backward screw propeller surface.

Therefore, the present invention prevents erosion of the backward screw propeller due to the TVC generated by the forward screw propeller in the twin-screw ship of the OLP type.

A propulsion device of a ship according to the present invention includes: a port side screw propeller; and a starboard side screw propeller provided in a forward or backward direction in a longitudinal direction of the ship from the port side screw propeller, such that a part of propeller wings of the starboard side screw propeller overlaps with propeller wings of the port side screw propeller. One of the port side screw propeller and the starboard side screw propeller, which is on a forward side in a longitudinal direction of the ship, is a forward screw propeller, and the other is a backward screw propeller. The forward screw propeller has a shape by which tip vortex cavitations are more difficult to be generated by the forward screw propeller than the backward screw propeller.

In the propulsion device, the number of propeller wings of the forward screw propeller is more than the number of propeller wings of the backward screw propeller.

In the propulsion device, an area of each propeller wing of the forward screw propeller is larger than that of propeller wings of the backward screw propeller.

In the propulsion device, a pitch of a wing tip of each propeller wing of the forward screw propeller is smaller than that of a wing tip of each propeller wing of the backward screw propeller.

In the propulsion device, a wing width near the wing tip of each wing of the forward screw propeller is wider than a wing width near the wing tip of the backward screw propeller.

In the propulsion device, a skew of the forward screw propeller is a forward skew, and a skew of the backward screw propeller is a backward skew.

In the propulsion device, a winglet or a wing tip board is provided for the wing tip of each of propeller wings of the forward screw propeller, and neither of the winglet or the wing tip board is provided for the wing tip of the backward screw propeller.

A ship according to the present invention is provided with any of the above propulsion devices.

According to the present invention, the propulsion device and the ship using the propulsion device are provided, in which erosion of the backward screw propeller due to TVC generated by the forward screw propeller is prevented.

DESCRIPTION OF EMBODIMENTS

Hereinafter, a propulsion device and a ship using the same according to the present invention will be described in detail with reference to the attached drawings.

[First Embodiment]

Figure 1:
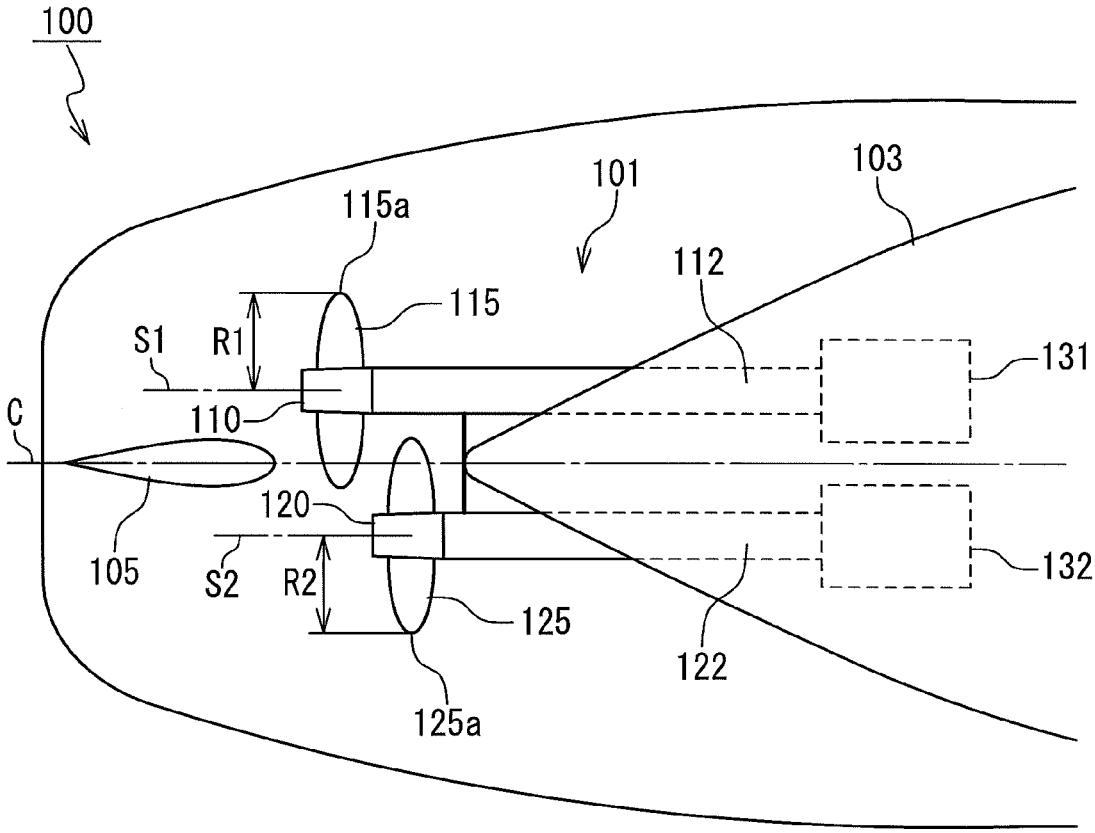
FIG. 1 is a bottom view of a stern portion of a ship according to a first embodiment of the present invention.

Referring to FIG. 1, a ship 100 according to a first embodiment of the present invention is a twin-screw ship of an OLP type. The ship 100 is provided with a propulsion device 101 and a rudder 105. The propulsion device 101 is provided with a starboard side main engine 131, a port side main engine 132, a starboard side screw propeller axis 112, a port side screw propeller axis 122, a port side screw propeller 110 and a starboard side screw propeller 120. The starboard side main engine 131 and the port side main engine 132 are arranged in a stern hull 103. The starboard side screw propeller 110 is provided with a plurality of propeller wings 115. The portside screw propeller 120 is provided with a plurality of propeller wings 125. The starboard side screw propeller 110 is provided such that a part of propeller wings 115 overlaps the propeller wings 125 of the port side screw propeller 120 in a backward position in a longitudinal direction of the ship (OLP structure). The rudder 105 is provided on the hull centerline C in a backward position from the starboard side screw propeller 110 and the port side screw propeller 120. The starboard side screw propeller 110 is connected with the starboard side main engine 131 through the starboard side screw propeller axis 112. The port side screw propeller 120 is connected with the port side main engine 132 through the port side screw propeller axis 122. The starboard side main engine 131 rotates the starboard side screw propeller 110 around a rotation axis S1. The port side main engine 132 rotates the port side screw propeller 120 around a rotation axis S2. The rotation axis S1 is located on the right side from the hull centerline C and the rotation axis S2 is located on the left side from the hull centerline C. The starboard side screw propeller 110 and the port side screw propeller 120 rotate in an outboard direction at the tops of the propellers. That is, the starboard side screw propeller 110 rotates in a clockwise direction by moving upwardly when the propeller wing 115 crosses the hull centerline C. The port side screw propeller 120 rotates in a counter-clockwise direction by moving upwardly when the propeller wing 125 crosses the hull centerline C. The propeller radius R1 of the starboard side screw propeller 110 is equal to a distance from the rotation axis S1 to a propeller wing tip 115*a*. The propeller radius R2 of the port side screw propeller 120 is equal to a distance from the rotation axis S2 to a propeller wing tip 125*a*. The propeller radius R1 and the propeller radius R2 may be same or may be different.

Hereinafter, a case which the starboard side screw propeller 110 is located in a backward direction from the port side screw propeller 120 will be described. However, the starboard side screw propeller 110 may be located in a forward direction from the port side screw propeller 120. In the following description, the starboard side screw propeller 110 is called a backward screw propeller 110 and the port side screw propeller 120 is called a forward screw propeller 120.

The forward screw propeller 120 and the backward screw propeller 110 are different from each other in a propeller shape, and the forward screw propeller 120 has a propeller wing shape by which it is more different to generate tip vortex cavitations (TVC) than the backward screw propeller 110. For example, the propeller wing shape of the backward screw propeller 110 is designed to assign high priority to propulsion efficiency. The propeller wing shape of the forward screw propeller 120 is designed in such a manner that it is difficult for TVC to be generated even if the propulsion efficiency becomes sacrifice, by changing the propeller wing shape of the backward screw propeller 110. Therefore, erosion of the backward screw propeller due to the TVC generated by the forward screw propeller 120 is prevented.

Figure 2:
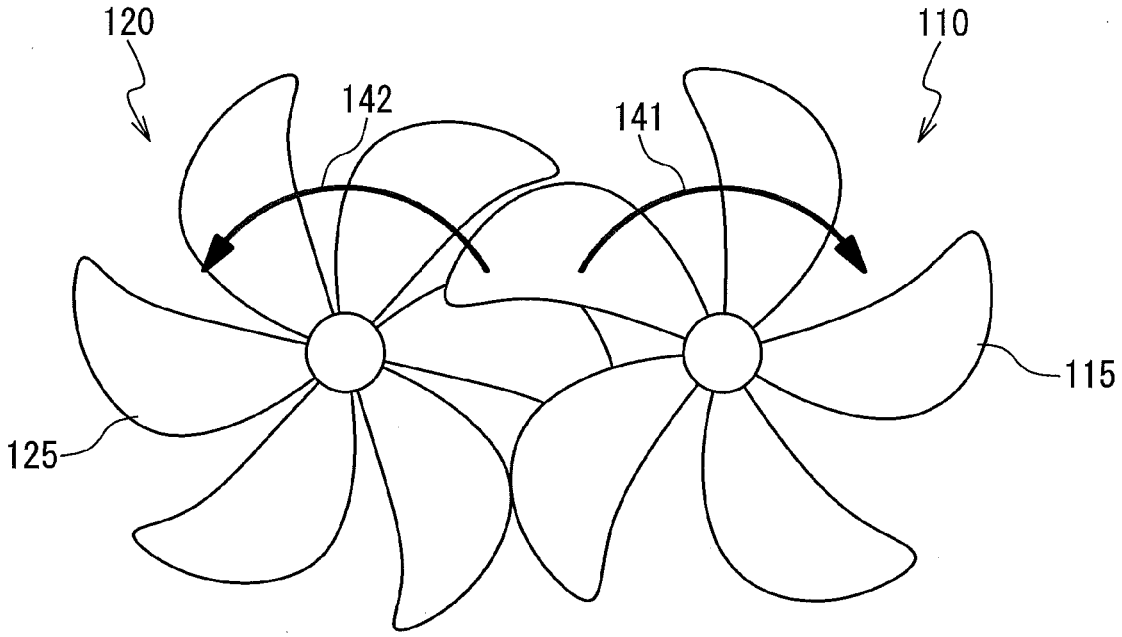
FIG. 2 is a diagram showing a forward screw propeller and a backward screw propeller in the ship according to the first embodiment when viewed from the stern.

Referring to FIG. 2, the propeller wing shapes of the forward screw propeller 120 and the backward screw propeller 110 are will be described specifically. The number of propeller wings 125 of the forward screw propeller 120 may be more than the number of propeller wings 115 of the backward screw propeller 110. Therefore, the TVC is difficult to be generated by the forward screw propeller 120 so that the erosion of the backward screw propeller due to TVC generated by the forward screw propeller 120 is prevented. It is shown in FIG. 2 that the rotation direction 142 of the forward screw propeller 120 and the rotation direction 141 of the backward screw propeller 110 are the outboard direction at the top position of the propellers.

In FIG. 2, both of the skew of the forward screw propeller 120 and the skew of the backward screw propeller 110 are backward skews, but both of the skew of the forward screw propeller 120 and the skew of the backward screw propeller 110 may be forward skews.

[Second Embodiment]

Figure 3:
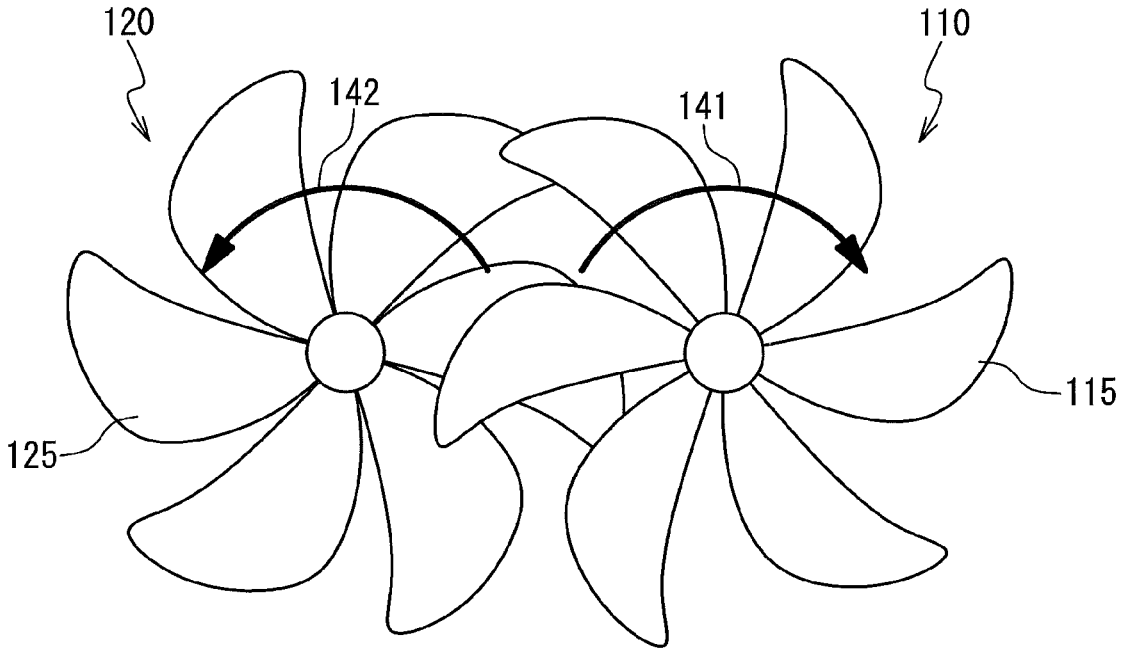
FIG. 3 is a diagram showing the forward screw propeller and the backward screw propeller in a second embodiment of the present invention when viewed from the stern.

Referring to FIG. 3, the propeller wing shapes of the forward screw propeller 120 and the backward screw propeller 110 according to a second embodiment of the present invention will be described. The area of each of the propeller wings 125 of the forward screw propeller 120 is larger than the area of each of the propeller wings 115 of the backward screw propeller 110. Therefore, the TVC is difficult to be generated by the forward screw propeller 120 so that the erosion of the backward screw propeller due to the TVC generated by the forward screw propeller 120 is prevented.

In FIG. 3, both of the skew of the forward screw propeller 120 and the skew of the backward screw propeller 110 are a backward skew, but the forward screw propeller 120 and the backward screw propeller 110 may be forward skews.

[Third Embodiment]

Figure 4:
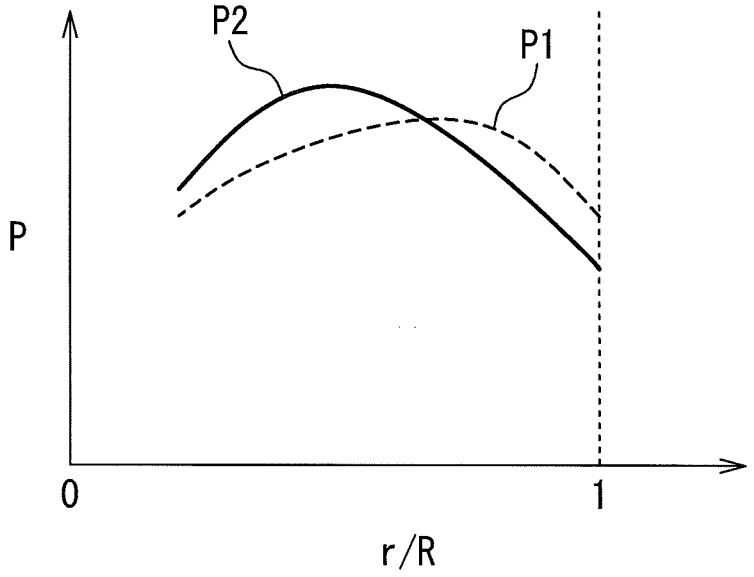
FIG. 4 is a graph showing comparison of a pitch of the forward screw propeller and a pitch of the backward screw propeller in a third embodiment of the present invention.

Refers to FIG. 4, the propeller wing shapes of the forward screw propeller 120 and the backward screw propeller 110 according to a third embodiment of the present invention will be described. In the graph of FIG. 4, the horizontal axis is a dimensionless distance r/R from the rotation axis of the propeller and the vertical axis is a propeller wing pitch P. A curve P1 shows a correspondence relation of the pitch of propeller wing 115 and the dimensionless distance r1/R1 and a curve P2 shows a correspondence relation of the pitch of propeller wing 125 and the dimensionless distance r2/R2. Here, a symbol r1 shows a distance from the rotation axis S1 and a symbol r2 shows a distance from the rotation axis S2. The pitch at the propeller wing tip 125*a* (r2/R2=1) is smaller than the pitch at the propeller wing tip 115*a* (r1/R1=1). Therefore, the TVC is difficult to be generated by the forward screw propeller 120 so that the erosion of the backward screw propeller due to the TVC generated by the forward screw propeller 120 is prevented. It should be noted that if the pitch of the propeller wing tip 125*a* is smaller than the pitch at the propeller wing tip 115*a*, the curve P1 and the curve P2 are not limited to the shape shown in FIG. 4.

[Fourth Embodiment]

Refers to FIG. 5, the propeller wing shapes of the forward screw propeller 120 and the backward screw propeller 110 according to a fourth embodiment of the present invention will be described. The wing width W2 of propeller wing 125 in the neighborhood of the propeller wing tip 125*a* of the forward screw propeller 120 is wider than the wing width W1 of propeller wing 115 in the neighborhood of the propeller wing tip 115*a* of the backward screw propeller 110. For example, it is supposed that a distance from the rotation axis S2 is r2 and a distance from the rotation axis S1 is r1. In this case, the wing width W2 is the wing width of propeller wing 125 at the position of r2/R2=0.95, and the wing width W1 is the wing width of propeller wing 115 at the position of r1/R1=0.95. Therefore, the TVC is difficult to be generated by the forward screw propeller 120 and the erosion of the backward screw propeller due to the TVC generated by the forward screw propeller 120 is prevented.

Figure 5:
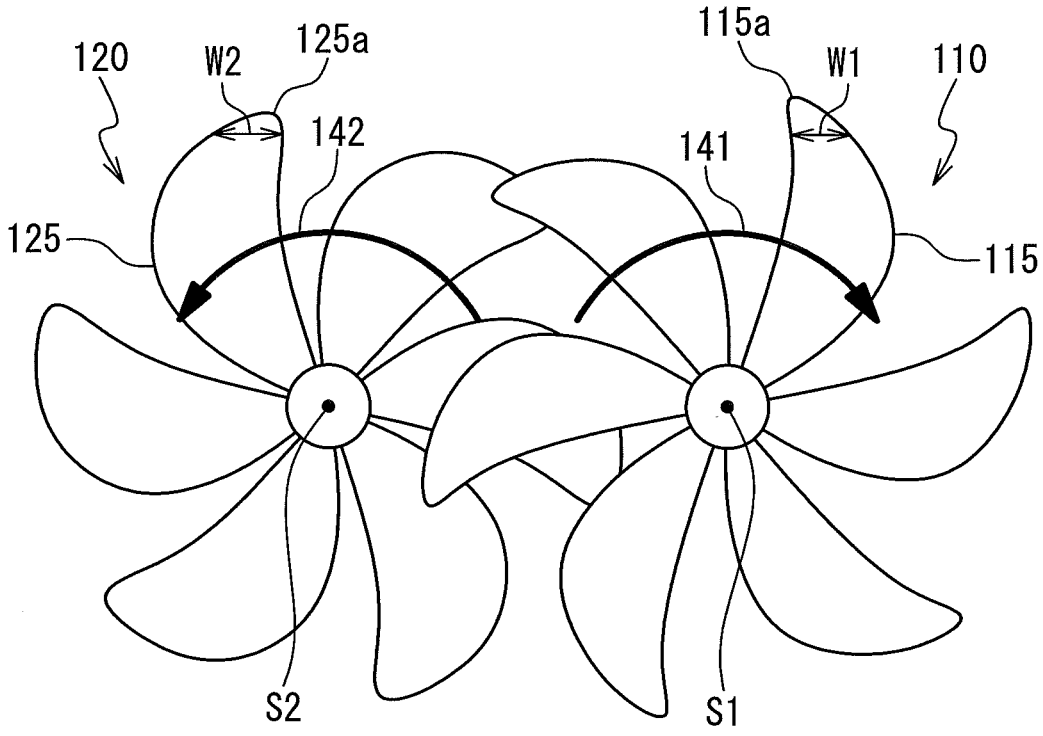
FIG. 5 is a diagram showing the forward screw propeller and the backward screw propeller in a fourth embodiment of the present invention when viewed from the stern.

In FIG. 5, both of the skew of the forward screw propeller 120 and the skew of the backward screw propeller 110 are backward skews, but both of the skew of the forward screw propeller 120 and the skew of the backward screw propeller 110 may be forward skews.

[Fifth Embodiment]

Figure 6:
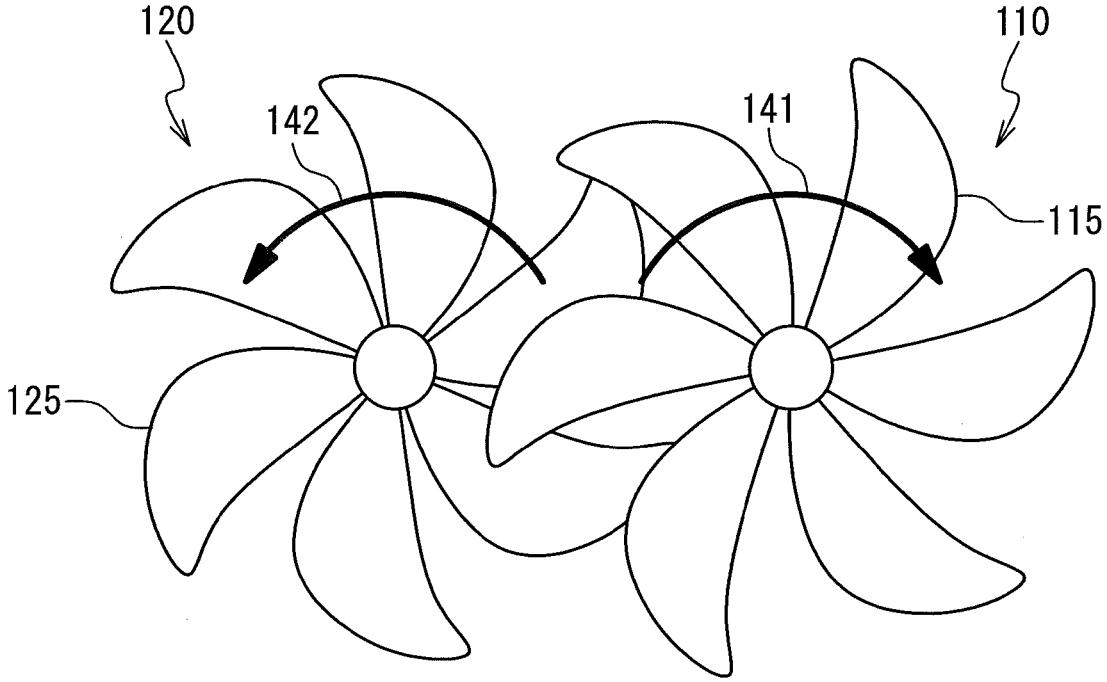
FIG. 6 is a diagram showing the forward screw propeller and the backward screw propeller in a fifth embodiment of the present invention when viewed from the stern.

Refers to FIG. 6, the propeller wing shapes of the forward screw propeller 120 and the backward screw propeller 110 according to a fifth embodiment of the present invention will be described. The skew of the forward screw propeller 120 is a forward skew and the skew of the backward screw propeller 110 is a backward skew. Therefore, the TVC is difficult to be generated by the forward screw propeller 120 and the erosion of the backward screw propeller due to the TVC generated by the forward screw propeller 120 is prevented.

[Sixth Embodiment]

Figure 7A:
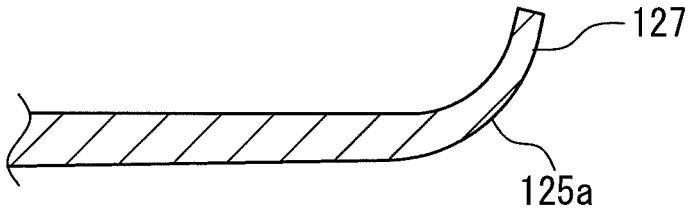
FIG. 7A is a sectional view showing an example of a wing tip shape of each wing of the forward screw propeller in a sixth embodiment of the present invention.

Referring to FIG. 7A, an example of the shape of the propeller wing tip of the forward screw propeller 120 according to a sixth embodiment of the present invention will be described. A winglet 127 is provided for the wing tip 125*a* of each wing of the forward screw propeller 120. The winglet 127 may stick out into the front side or the back side.

Figure 7B:
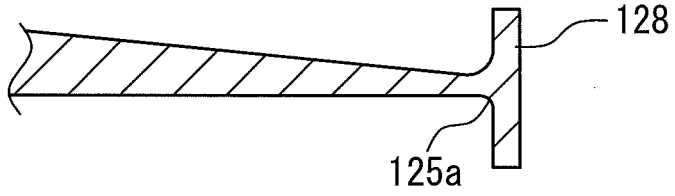
FIG. 7B is a sectional view showing another example of the wing tip shape of each wing of the forward screw propeller in the sixth embodiment of the present invention.

Referring to FIG. 7B, another example of the shape of the wing tip of each wing of the forward screw propeller 120 according to the sixth embodiment of the present invention will be described. A wing tip board 128 is provided for the wing tip 125*a* of each wing of the forward screw propeller 120.

In the present embodiment, while the winglet 127 or the wing tip board 128 is provided for the wing tip 125*a* of each wing of the forward screw propeller 120, neither of the winglet or the wing tip board is provided for the propeller wing tip 115*a* of the backward screw propeller 110. Therefore, the TVC is difficult to be generated by the forward screw propeller 120 and the erosion of the backward screw propeller due to the TVC generated by the forward screw propeller 120 is prevented.

Although the embodiments of the present invention have been described as above, the present invention is not limited to the embodiments. Various modifications can be carried and the above embodiments may be combined.

What is claimed is:

1. A propulsion device of a ship, the propulsion device comprising:

a port side screw propeller; and a starboard side screw propeller provided in a forward or backward direction in a longitudinal direction of the ship from said port side screw propeller, such that a part of propeller wings of said starboard side screw propeller overlaps with propeller wings of said port side screw propeller, wherein one of said port side screw propeller and said starboard side screw propeller, which is on a forward side in a longitudinal direction of the ship, is a forward screw propeller, and the other is a backward screw propeller, and wherein the number of propeller wings of said forward screw propeller is more than the number of propeller wings of said backward screw propeller.

2. A propulsion device of a ship, the propulsion device comprising:

a port side screw propeller; and a starboard side screw propeller provided in a forward or backward direction in a longitudinal direction of the ship from said port side screw propeller, such that a part of propeller wings of said starboard side screw propeller overlaps with propeller wings of said port side screw propeller, wherein one of said port side screw propeller and said starboard side screw propeller, which is on a forward side in a longitudinal direction of the ship, is a forward screw propeller, and the other is a backward screw propeller, and wherein an area of each of the propeller wings of said forward screw propeller is larger than that of each of the propeller wings of said backward screw propeller.

3. A propulsion device of a ship, the propulsion device comprising:

a port side screw propeller; and a starboard side screw propeller provided in a forward or backward direction in a longitudinal direction of the ship from said port side screw propeller, such that a part of propeller wings of said starboard side screw propeller overlaps with propeller wings of said port side screw propeller, wherein one of said port side screw propeller and said starboard side screw propeller, which is on a forward side in a longitudinal direction of the ship, is a forward screw propeller, and the other is a backward screw propeller, and wherein a skew of said forward screw propeller is a forward skew, and a skew of said backward screw propeller is a backward skew.

4. The propulsion device according to claim 1, wherein a pitch of a wing tip of each of the propeller wings of said forward screw propeller is smaller than that of a wing tip of each of the propeller wings of said backward screw propeller.

5. The propulsion device according to claim 1, wherein a wing width at a position near a wing tip of each of the propeller wings of said forward screw propeller is wider than a wing width at a position near a wing tip of each of the propeller wings of said backward screw propeller.

6. A propulsion device of a ship, the propulsion device comprising:

a port side screw propeller; and a starboard side screw propeller provided in a forward or backward direction in a longitudinal direction of the ship from said port side screw propeller, such that a part of propeller wings of said starboard side screw propeller overlaps with propeller wings of said port side screw propeller, wherein one of said port side screw propeller and said starboard side screw propeller, which is on a forward side in a longitudinal direction of the ship, is a forward screw propeller, and the other is a backward screw propeller, and wherein a winglet or a wing tip board is provided for a wing tip of each of propeller wings of said forward screw propeller, and neither of the winglet or the wing tip board is provided for the wing tip of said backward screw propeller.

7. A ship comprising a propulsion device which comprises:

a port side screw propeller; and a starboard side screw propeller provided in a forward or backward direction in a longitudinal direction of the ship from said port side screw propeller, such that a part of propeller wings of said starboard side screw propeller overlaps with propeller wings of said port side screw propeller, wherein one of said port side screw propeller and said starboard side screw propeller, which is on a forward side in a longitudinal direction of the ship, is a forward screw propeller, and the other is a backward screw propeller, and wherein the number of propeller wings of said forward screw propeller is more than the number of propeller wings of said backward screw propeller.

8. A ship comprising a propulsion device which comprises:

a port side screw propeller; and a starboard side screw propeller provided in a forward or backward direction in a longitudinal direction of the ship from said port side screw propeller, such that a part of propeller wings of said starboard side screw propeller overlaps with propeller wings of said port side screw propeller, wherein one of said port side screw propeller and said starboard side screw propeller, which is on a forward side in a longitudinal direction of the ship, is a forward screw propeller, and the other is a backward screw propeller, wherein said forward screw propeller is different from said backward screw propeller in the number of propeller wings or an area of each of the propeller wings, and wherein an area of each of the propeller wings of said forward screw propeller is larger than that of each of the propeller wings of said backward screw propeller.

9. A ship comprising a propulsion device which comprises:

a port side screw propeller; and a starboard side screw propeller provided in a forward or backward direction in a longitudinal direction of the ship from said port side screw propeller, such that a part of propeller wings of said starboard side screw propeller overlaps with propeller wings of said port side screw propeller, wherein one of said port side screw propeller and said starboard side screw propeller, which is on a forward side in a longitudinal direction of the ship, is a forward screw propeller, and the other is a backward screw propeller, wherein said forward screw propeller is different from said backward screw propeller in the number of propeller wings or an area of each of the propeller wings, and wherein a skew of said forward screw propeller is a forward skew, and a skew of said backward screw propeller is a backward skew.

10. The ship according to claim 7, wherein a pitch of a wing tip of each of the propeller wings of said forward screw propeller is smaller than that of a wing tip of each of the propeller wings of said backward screw propeller.

11. The ship according to claim 7, wherein a wing width at a position near a wing tip of each of the propeller wings of said forward screw propeller is wider than a wing width at a position near a wing tip of each of the propeller wings of said backward screw propeller.

12. A ship comprising s propulsion device which comprises:

a port side screw propeller; and a starboard side screw propeller provided in a forward or backward direction in a longitudinal direction of the ship from said port side screw propeller, such that a part of propeller wings of said starboard side screw propeller overlaps with propeller wings of said port side screw propeller, wherein one of said port side screw propeller and said starboard side screw propeller, which is on a forward side in a longitudinal direction of the ship, is a forward screw propeller, and the other is a backward screw propeller, wherein said forward screw propeller is different from said backward screw propeller in the number of propeller wings or an area of each of the propeller wings, and wherein a winglet or a wing tip board is provided for a wing tip of each of propeller wings of said forward screw propeller, and neither of the winglet or the wing tip board is provided for the wing tip of said backward screw propeller.

13. The propulsion device according to claim 2, wherein a pitch of a wing tip of each of the propeller wings of said forward screw propeller is smaller than that of a wing tip of each of the propeller wings of said backward screw propeller.

14. The propulsion device according to claim 2, wherein a wing width at a position near a wing tip of each of the propeller wings of said forward screw propeller is wider than a wing width at a position near a wing tip of each of the propeller wings of said backward screw propeller.

15. The propulsion device according to claim 3, wherein a pitch of a wing tip of each of the propeller wings of said forward screw propeller is smaller than that of a wing tip of each of the propeller wings of said backward screw propeller.

16. The propulsion device according to claim 3, wherein a wing width at a position near a wing tip of each of the propeller wings of said forward screw propeller is wider than a wing width at a position near a wing tip of each of the propeller wings of said backward screw propeller.

17. The propulsion device according to claim 6, wherein a pitch of the wing tip of each of the propeller wings of said forward screw propeller is smaller than that of the wing tip of each of the propeller wings of said backward screw propeller.

18. The propulsion device according to claim 6, wherein a wing width at a position near the wing tip of each of the propeller wings of said forward screw propeller is wider than a wing width at a position near the wing tip of each of the propeller wings of said backward screw propeller.

19. The ship according to claim 8, wherein a pitch of a wing tip of each of the propeller wings of said forward screw propeller is smaller than that of a wing tip of each of the propeller wings of said backward screw propeller.

20. The ship according to claim 8, wherein a wing width at a position near a wing tip of each of the propeller wings of said forward screw propeller is wider than a wing width at a position near a wing tip of each of the propeller wings of said backward screw propeller.

21. The ship according to claim 9, wherein a pitch of a wing tip of each of the propeller wings of said forward screw propeller is smaller than that of a wing tip of each of the propeller wings of said backward screw propeller.

22. The ship according to claim 9, wherein a wing width at a position near a wing tip of each of the propeller wings of said forward screw propeller is wider than a wing width at a position near a wing tip of each of the propeller wings of said backward screw propeller.

23. The ship according to claim 12, wherein a pitch of the wing tip of each of the propeller wings of said forward screw propeller is smaller than that of the wing tip of each of the propeller wings of said backward screw propeller.

24. The ship according to claim 12, wherein a wing width at a position near the wing tip of each of the propeller wings of said forward screw propeller is wider than a wing width at a position near the wing tip of each of the propeller wings of said backward screw propeller.

* * * * *